United States Patent [19]

Mitchell

[11] Patent Number: 4,956,829

[45] **Date of Patent: * Sep. 11, 1990**

[54] TIMEPIECE WITH MODIFIED CLOCK RATE FOR FACILITING ADAPTATION TO NEW TIME STANDARD

[76] Inventor: Ross E. Mitchell, 4 Allston St., Newtonville, Mass. 02160

[ * ] Notice: The portion of the term of this patent subsequent to Feb. 20, 2007 has been disclaimed.

[21] Appl. No.: 455,564

[22] Filed: Dec. 22, 1989

Related U.S. Application Data

[63] Continuation of Ser. No. 325,293, Mar. 17, 1989, Pat. No. 4,901,296.

[51] Int. Cl.[5] ..... G04C 9/00

[52] U.S. Cl. ..... 368/185; 368/187; 368/21

[58] Field of Search ..... 368/185–199, 368/223, 228, 238, 21–27

[56] References Cited

U.S. PATENT DOCUMENTS 4,763,311 8/1988 Marvosh ..... 368/228

4,901,296 2/1990 Mitchell ..... 368/185

*Primary Examiner*—Bernard Roskoski

*Attorney, Agent, or Firm*—David Pressman

[57] ABSTRACT

An electronic watch includes a "traveler's time" function which can be activated when a wearer leaves on a long trip, east or west by plane, boat or the like. This function will advance or retard the operation rate of the watch so that after a user-determined trip time has elapsed, the watch will display the actual local time at the arrival location, and the watch will resume operation at its normal rate. By glancing at the watch from time to time, a traveler can become accustomed gradually to a time change caused by his travel through different time zones so that the psychological effects of "jet lag" are minimized. The watch includes a microprocessor (10), a quartz crystal (20) for providing a time standard, a display (30) for displaying the time, and a set of switches (40–90) for activating the watch's functions. The microprocessor includes a set of registers (145 to 160) for storing the departure, destination, and traveler's times, and for controlling operation of the watch.

15 Claims, 6 Drawing Sheets

TIMEPIECE WITH MODIFIED CLOCK RATE FOR FACILITING ADAPTATION TO NEW TIME STANDARD

CROSS REFERENCE TO RELATED APPLICATION

This is a continuation of application Ser. No. 07/325,293, filed Mar. 17, 1989, now U.S. Pat. No. 4,901,296, granted Feb. 13, 1990.

BACKGROUND

1. Field of Invention

This invention relates generally to watches, and more particularly to watches especially suited for travelers.

2. Description of Prior Art

Present-day personal timepieces, such as wrist and pocket watches, employ a quartz crystal to generate a precise timing signal which is stepped down in frequency to produce trains of timing signals to drive the watch display. In the case of a watch with an analog display, those timing signals drive a step motor which turns the hour and minute hands of the watch. In the case of a watch with a digital display, the timing signal trains control a circuit which drives a LED or liquid crystal display. An electronic watch with an analog display is shown, for example, in patent 4,505,594, to Kawahara et al. (1985), while patent 4,316,272, to Seikosha (1982) illustrates a watch having a digital display.

A major problem facing people who travel over long distances is adapting to changes in local time caused by their passing through different time zones. This condition is commonly referred to as jet lag. Persons traveling a long distance will often set their watches to the local time upon arrival at the destination. While a person arriving in New York from California may know that the local time is 5:00 P.M., Eastern Standard Time, this person is likely to feel that the "real" time is 2:00 P.M., Eastern Standard Time. This is because the person did not experience a progression in time from the place of departure to the destination location. Thus, after having abruptly set the watch three hours ahead of the current local time of the departure location, the traveler must now attempt to believe that this new local time is the "real" time for him or her. For a long voyage, it often takes a traveler a day or even more to acclimate, both physically and psychologically, to the local time at the new location.

Some present day electronic watches include a function which enables the watch to display local time at various cities in all of the different time zones of the world. Examples of such watches are found in patents 4,072,005 to Teshima et al. (1978); 4,316,272 to Seikosha (1982); and 4,620,797 to Besson and Meister (1986). A traveler in Boston embarking on a trip to London at 10:00 A.M. may actuate the world time function switch of such a watch and call up London on the watch which will thereupon display the corresponding local time in London, i.e., 3:00 P.M. Thus the traveler becomes aware immediately of the time difference between the two locations. However, this knowledge really does nothing to overcome the jet lag feeling that the traveler will experience upon reaching London. This is because whether the traveler switches the watch to London time upon departing from Boston, while in the air over the Atlantic, or upon reaching England, the watch, because it switches between the two local times substantially instantaneously, does not help the traveler to become accustomed psychologically to the new local time.

There does exist a timepiece which changes its time display automatically as it passes from one time zone to the next. This timepiece is described in patent 4,204,398, to Lemelson (1980), and includes a radio receiver which responds to signals generated from a remote transmitter located, for example, in the aircraft in which the user is traveling. As the aircraft passes from one time zone to the next, this timepiece can automatically change its display to show the current time in the new time zone. However, this watch does not permit the user to gradually adapt to the new time zones. The watch is stepped back or forward in abrupt hourly increments. Further, this watch is quite complex and costly. It supposes that transmitters have been placed which have access to the current local time at any point on the earth. This, too, represents a costly and cumbersome requirement. Consequently, its workings are not practical for incorporation into a relatively low cost personal timepiece, such as a wrist or pocket watch.

Marvosh, in U.S. Pat. No. 4,763,311, describes a double clock, one face of which runs at a fast or slow rate for six months of each year. The purpose of this clock is to gradually alter the user's time standard in order to take advantage of all available daylight throughout the year. It does not address the need for travelers to adapt to an existing time standard.

OBJECTS AND ADVANTAGES

Accordingly, one object and advantage of this invention is to provide a timepiece which can be carried on the person and which reduces jet lag caused by travel between different time zones.

Other objects are to provide a watch which will assist the wearer to acclimate to local time changes caused by easterly or westerly travel over relatively great distances between two locations, to provide such a watch which enables a wearer to acclimate to the change in local time over the course of the trip, and to provide a watch of this type which will not cost appreciably more than a conventional electronic watch having a plural function display capability.

Further objects will become apparent from the ensuing description, claims and accompanying drawings.

SUMMARY

Briefly, in accordance with the present invention, an electronic watch includes a "traveler's time" function which can be activated when a wearer leaves on an east or westbound trip. This function will advance or retard the operation rate of the watch so that after a user-determined trip time has elapsed, the timepiece will display the actual local time at the arrival location, and from that point, will return automatically to its normal operating speed.

In one watch implementation, the user enters the time difference at the departure and arrival locations and whether those hours will be gained or lost, i.e., whether one is traveling east or west. This is done by actuating a function which causes a number of hours to be displayed along with a + or −. Following this, the user enters the length of time over which the change to the new time zone is to take place, i.e., the approximate trip time. Then the user presses a function button to activate the traveler's time function. At that moment, the watch will begin to adjust to the arrival location time zone by either running faster or slower than normal. After the preset trip time has elapsed, the watch will display a time which matches the local time in the time zone of the arrival location. At this point, the traveler time function is automatically canceled and the watch resumes operation at its normal rate.

For example, assume that a person is traveling from Boston to San Francisco by airplane. The flight leaves the gate in Boston at 8:00 A.M., Eastern Standard Time. The flight is due to arrive in San Francisco at 11:25 A.M., Pacific Standard Time. Upon boarding the flight, the user knows that the flight time should be about six hours and that the time in San Francisco is three hours earlier than Bostime time. Thus, using a function button, the user enters "−3" to indicate that three hours must be lost during the course of the trip. Then, using another function button, the user enters "6:00", indicating that the three hours should be lost over a six-hour time period. The user then starts the function and the watch begins to run at a rate which is 6/3, or half normal speed.

Throughout the flight, the time displayed by the watch represents the time the user should consider as "real." It is advantageous that the user not know or be concerned with the actual local time in either the departure location or the arrival location during this transition period. Most airplanes are isolated environments and are, therefore, particularly well suited to providing the user with an opportunity to experience the "traveler's time" displayed by the watch as being "real." In this connection, it is incumbent upon the user to look occasionally at the time shown on the watch in order to gain maximum benefit from this watch feature. In this example, the traveler's time is gradually regressing, which leaves the user at Pacific Standard Time, six hours from the moment the function switch on the watch was actuated in Boston, i.e., 11:00 A.M. PST, assuming the function had been engaged at 8:00 A.M. EST. Thus, the user is not jolted into a net time zone at the destination, but rather, is eased into this new local time. As a result, upon arrival, the user feels more acclimated to the San Franciso local time since the user has experienced a gradual progression into the destination time zone.

For the return to Boston, the user programs the watch in the same fashion to gain an additional three hours in the approximately four and a half hours west-to-east trip time. The watch now operates faster than normal and thus displays the correct Eastern Standard Time after four and a half hours elapses and the plane is nearing its Boston destination.

The function can be engaged substantially prior to the commencement of travel and/or be set to terminate after the trip has been completed, so that users crossing time zones extremely rapidly, such as those traveling at very high latitudes or by means of supersonic transport, can provide themselves a sufficient period of time over which to adapt to the new time zone.

A less expensive version of the watch might operate so as not to permit the user to enter the amount of time allowed for the transition between the different time zones, but would gain or lose time at a constant rate, e.g., one hour every hour. Further, this rate could be provided as a default transition rate even on watches which allowed the user to set the rate. In this way, if the user were willing to accept the default, it would not be necessary to enter the transition period (travel time). Also, the watch can be implemented in conjunction with a conventional date function so that the date will be incremented or decremented if the destination time would cause the date to be other than the one at the departure location.

The function can as well be incorporated into a conventional electronic watch having a world time display function. In this embodiment, the user would not have to know the local time difference between the departure and arrival locations of his trip; the watch would display these times, often simultaneously. To use the watch, the traveler would then simply enter the expected trip time into the watch, select the destination, and engage the function. The watch would thereupon operate at a faster or slower rate to gain or lose the necessary time over the course of the trip such that the watch would display the correct local time at the arrival location upon completion of the entered trip time.

Still further, the traveler's time function can be incorporated into a conventional electronic watch having a multiple time zone display function. In this embodiment, the user would set the arrival location's time into the second time zone display. To use the watch, the traveler would then simply enter the travel time (or accept the default) and engage the function. The watch would then automatically determine the difference between the time zones and the likely direction of travel, i.e., east or west. This is the embodiment which will be covered in the detailed explanation which follows.

The preferred implementation of the travel function includes a microprocessor circuit and associated function switches to receive the input data and make the rate calculations described above to develop the timing signals to drive the watch display at the computed faster or slower rate. The electronic circuitry for doing this is well known in the art so that the incorporation of this invention into an otherwise conventional electronic watch should not unduly complicate the watch or materially add to its overall cost.

BRIEF DESCRIPTION OF THE DRAWINGS

FIGS. 3A through 3F are diagrams illustrating time progression during a typical use of the function.

FIG. 1—BLOCK DIAGRAM OF WATCH

FIG. 1 shows one preferred embodiment of the invention. Many timepieces manufactured today utilize microprocessors. These typically contain an internal memory, a number of internal registers, counters, decoders, etc. One such microprocessor, shown at 10, is the model COP424C, manufactured by National Semiconductor Corporation, 2900 Semiconductor Drive, Santa Clara, CA 95051, U.S.A. The application of these microprocessors to timekeeping is well known to those familiar with both horology and microprocessor technology.

Figure 1:
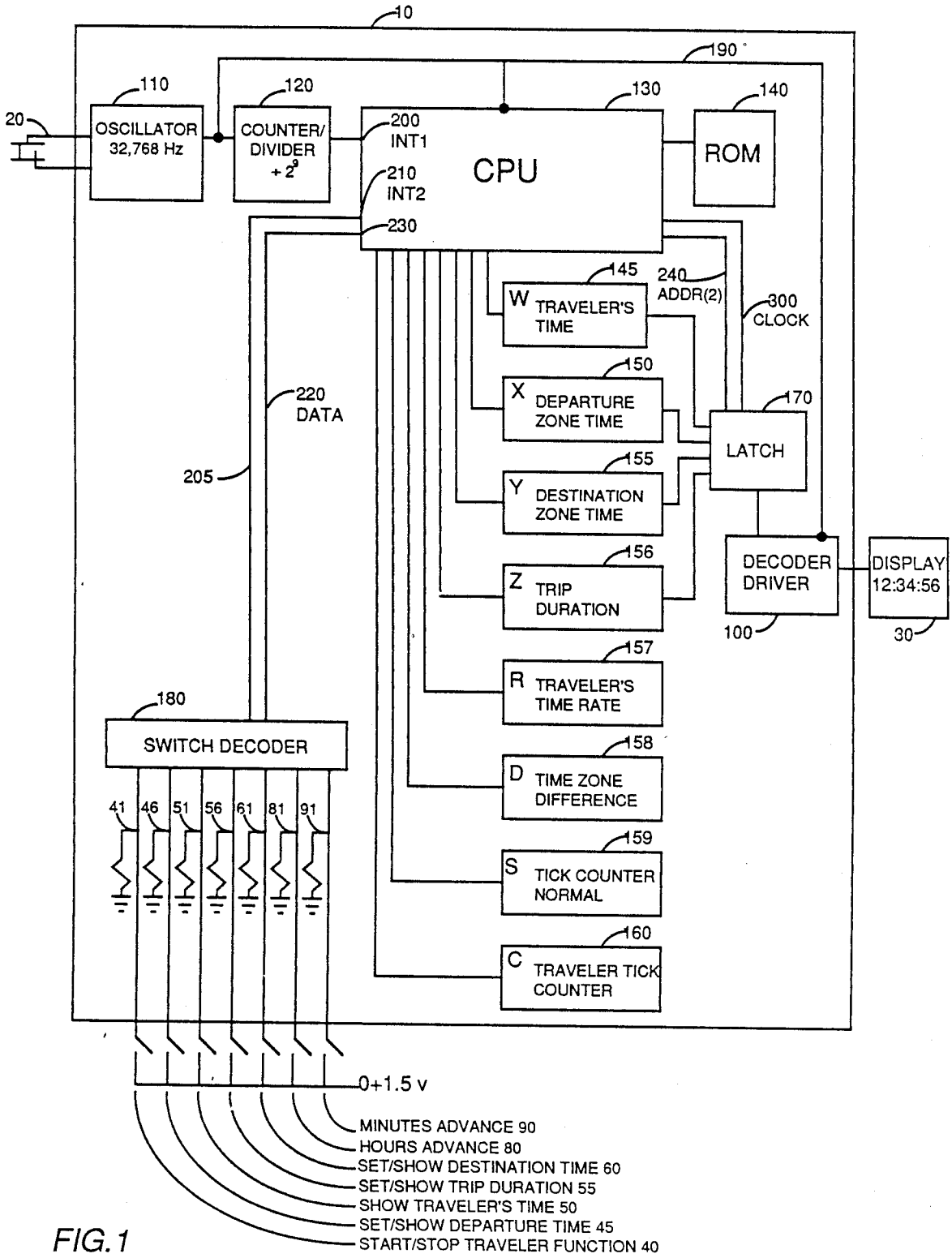
FIG. 1 is a block diagram showing the electronic system of a digital watch according to the invention.

The term "tick" will be used to denote 1/64 second. This is the rate at which the watch will be interrupted and at which the routine for adjusting the time will be executed.

Microprocessor 10 is supplied with an external quartz crystal 20 to provide a high frequency oscillator circuit. Other external components include batteries (not shown) which provide the energy to run the circuitry of the timepiece; a display 30 which, in this embodiment, would preferably be a liquid crystal horological display capable of showing hours, minutes and seconds; and a set of switches 40 through 90. The functions associated with each of switches 40 through 90 will be described in detail below. Display 30 is activated by a decoder/-driver 100 in microprocessor 10. When the traveler's time function is active, display 30 is programmed to show only hours and minutes, so that the user is not distracted by seconds advancing at an abnormally fast or slow rate.

Microprocessor 10 additionally contains an oscillator circuit 110, a counter/divider 120, a central processing unit (CPU) 130, a read-only memory (ROM) 140, registers W, X, Y, and Z, designated 145, 150, 155, and 156, respectively, registers R, D, S and C, labeled 157, 158, 159, and 160, respectively, and an accumulator and flag registers (not shown). The accumulator acts as a temporary storage register in where numbers can be stored in binary form and mathematical operations can be performed on these numbers and from where the results can be directed to other registers. A latch 170, a switch decoder 180, and the internal connections are also included as shown in FIG. 1.

Oscillator 110 provides an output square wave with 50% duty cycle, in well-known fashion. Divider 120 provides at its output a 64 Hz. square wave, again with a 50% duty cycle, in well-known fashion. High frequency clocking signal 190 is connected to CPU 130 and decoder/driver 100 to cause them to operate at a high speed. CPU 130 must be able to perform operations at a high rate of speed in order to complete numerous tasks each second. Decoder/driver 100 must also activate all parts of display 30 in a time short compared with a second. The operation of these two components is well known to those familiar with logic circuits.

CPU 130 is "interrupt" driven. It is normally waiting for instructions. It can optionally be "powered down" between interrupts to conserve battery energy. Input 200, labeled "INT 1" for "interrupt number 1," is activated at a rate of 64 Hz. CPU 130 typically recognizes interrupts as positive-going, logical transitions between zero volts (logic "0" or "false") and +1.5 volts (logic "1" or "true").

Input 210, labeled "INT 2" for "interrupt number 2," is activated whenever one of switches 40 through 90 is closed. The inputs to decoder 180 are normally held "low" or at logic "0" by resistors 41 through 91. When a switch is closed, the battery voltage, typically 1.5 volts, is momentarily connected to the associated input on decoder 180. In response, decoder 180 signals CPU 130 via interrupt line #2 (205) connected to input 210, and provides logical data on multiple lines 220, to input 230 of CPU 130, in well-known fashion.

CPU 130 can send data to registers W, X, Y, Z, R, D, S, and C, designated 145, 150, 155, 156, 157, 158, 159, and 160, respectively. It can also read the contents of these registers. The data in registers W, X, Y, and Z can be stored in latch 170. Multiple control lines 240 are used to select among the registers 145, 150, 155, and 156 in well-known fashion. Once a register is selected by address lines 240, a momentary pulse is applied to latch 170 via line 300 which connects an output of CPU 130 to the "latch" input of latch 170, and causes the data present at the input of latch 170 to be stored in the latch indefinitely, in well-known fashion. In this way, the data present in any of registers 145, 150, 155, or 156, which are representative of time, can be shown as the digits of time on display 30. In the present embodiment, register W 145 is used to show the current traveler's time. Register X 150 is used to store the "present" time of day, i.e., the departure time zone time. Register Y 155 is used to store the current time at the destination. Register Z is used to store the transition time, i.e., the duration of the trip.

Register R (157) is used to store the time zone transition rate which will be calculated by CPU 130 using data from Registers X, Y, Z, and D. Register D (158) is used to store the difference between the time at the departure location, and the time at the destination location, as a signal (+ or −) number. Register S (159) is a counter which will be incremented once for each successive tick of the timepiece, i.e., once per 1/64 second. This counter is used to increment the time at the departure and destination locations. Register C (160) is a counter which will also be incremented once for each tick of the timepiece. This counter is used to increment the traveler's time. There are other registers (not shown) capable of storing addresses, statuses, etc. The setting and operation of watches of this type are quite well known. See U.S. Pat. No. 4,316,272, to Seikosha (1982), for example, whose disclosure is incorporated by reference herein.

Finally, CPU 130 is provided with ROM 140 which contains multiple instructions which govern the operation of the timepiece. This concept is also well known to those skilled in the art of microprocessor technology.

FIG. 2—FLOW CHARTS

Figure 2A:
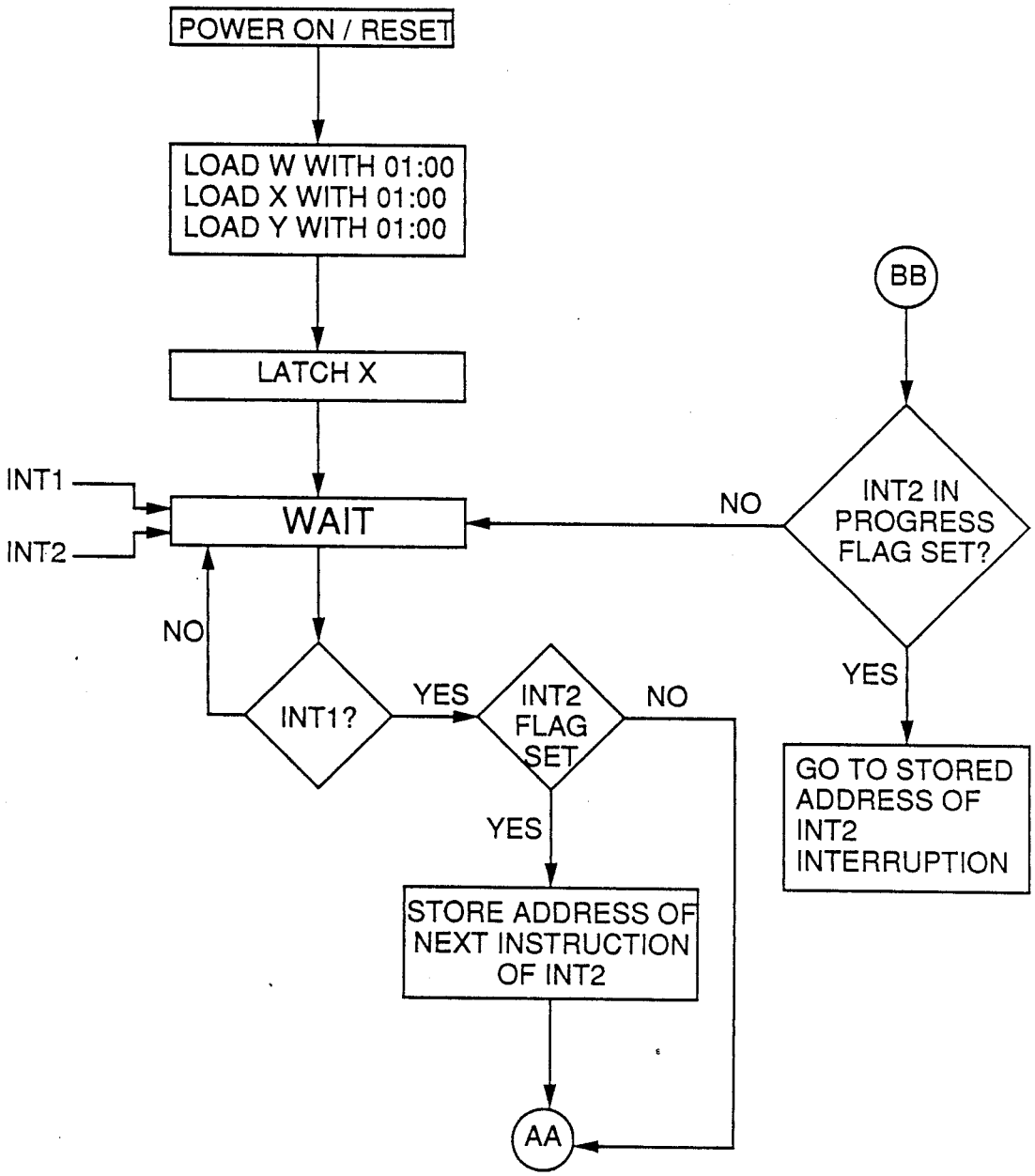
FIGS. 2A through 2D are flow charts whih denote one one means by which the traveler's time function can be implemented in the watch of FIG. 1.
Figure 2B:
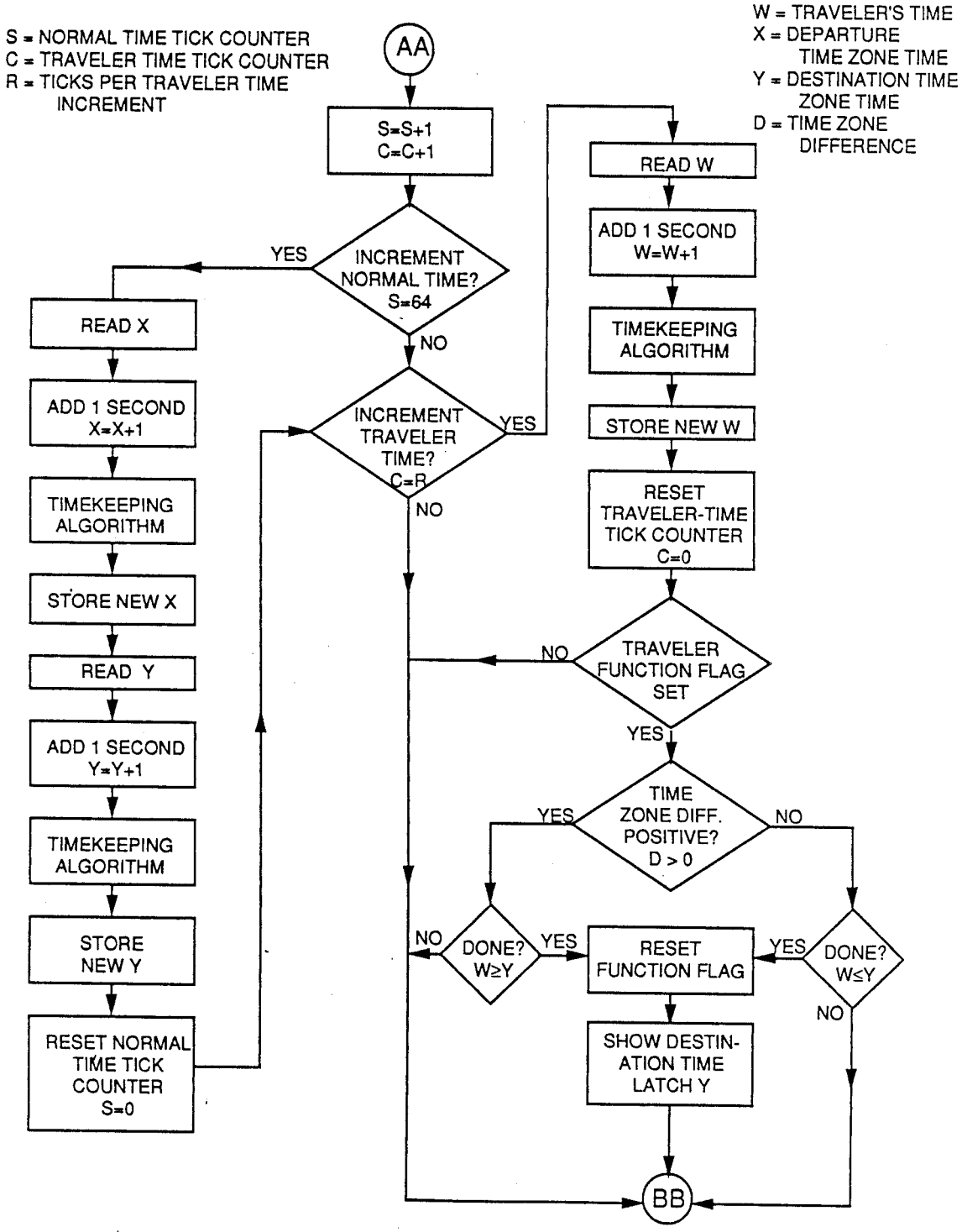
Figure 2C:
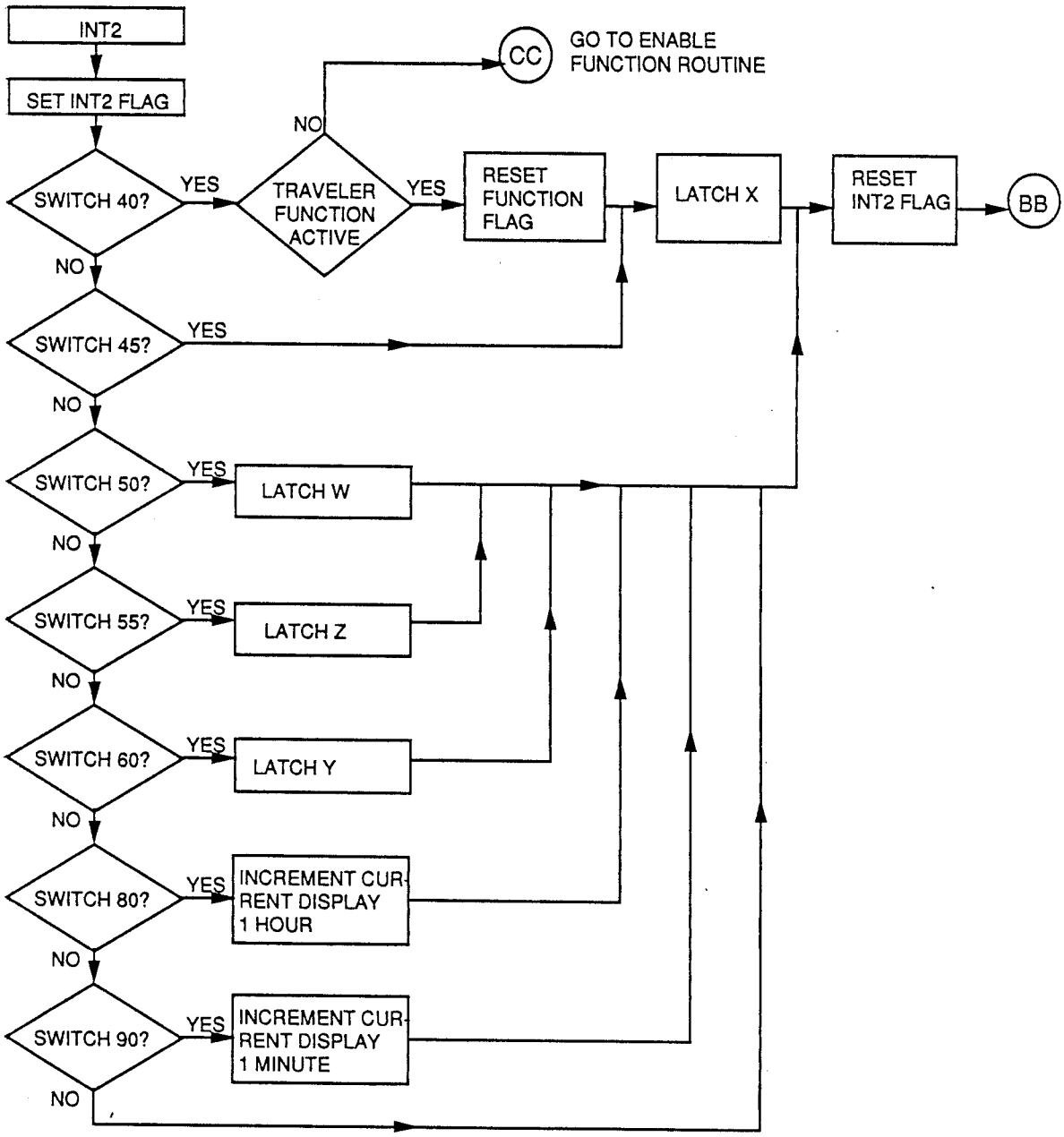
Figure 2D:
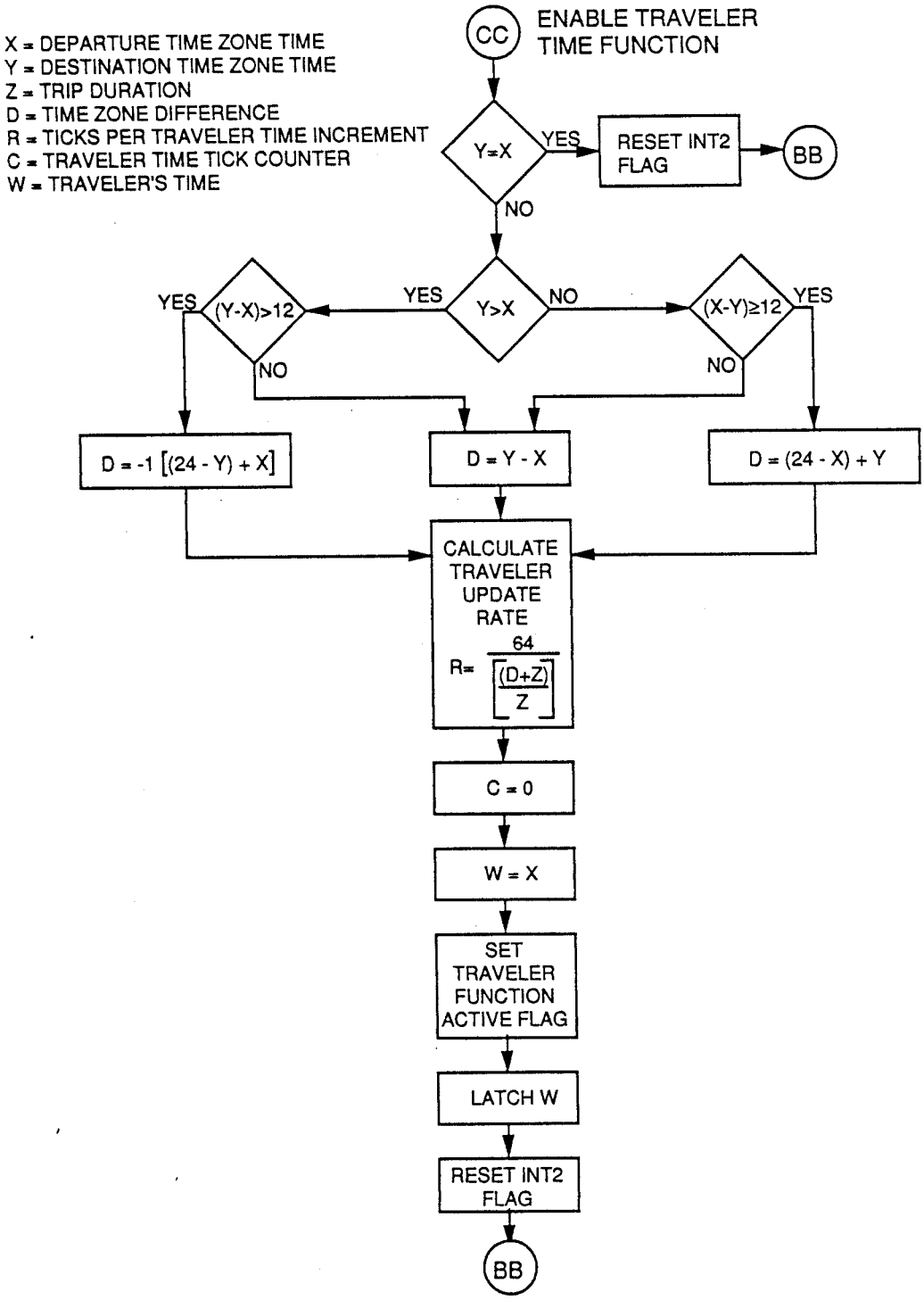

The principle of the present invention is best understood by consideration of the flow charts in FIGS. 2A through 2D and FIGS. 3A through 3E. FIGS. 2A and 2B show the series of instructions which are executed in response to INT 1 at input 200 (FIG. 1). FIGS. 2C and 2D show the sequence of instructions which are executed in response to INT 2, generated with each closure of a switch 40 through 90. The interrupts are prioritized. INT 1 has the higher priority and can be activated while INT 2 is in progress. INT 2 can never be operational while INT 1 is in progress.

FIG. 2A is a flowchart which illustrates how interrupts are handled. Upon initial power-up the watch loads 1:00 into registers W (145), X (150), and Y (155). Then the time in register X (150), i.e., departure time zone time, is displayed. The wait loop is entered. The processor will be interrupted (INT 1) each 1/64 second. Control will then be passed to the routine described in FIG. 2B, after the address of the interruption is saved, in the event that an INT 2 operation had been in progress.

FIG. 2B illustrates the means by which the departure, destination and traveler's current time is incremented, as well as the means by which the traveler's time function is terminated after arrival in the destination time zone. Counter S (159) is incremented once per INT 1 interruption of the CPU. When it reaches 64, one second has elapsed and it is time to increment the departure, register X (150), and the destination, register Y (155), time zone time by one second. The "timekeeping algorithm" referred to is a routine for incrementing minutes, hours, and dates at the proper time. All electronic timepieces must perform this function and its operation is well known in the art. Counter C (160) is also incremented once per INT 1 interruption of the CPU. When it equals the value stored in register R (157), it is time to increment the traveler's time register W (145) by one second. The value in register R (157) is determined in calculations shown in FIG. 2D below. After incrementing the traveler's time, a comparator determines if the function has completed, i.e., if the traveler's time substantially equals the destination time zone time. If so, the traveler time function is cancelled, and the destination time zone time (Y 155) is latched. Operation then resumes at the normal rate.

FIG. 2C shows the sequence of instructions which are executed in response to INT 2, generated with each closure of one of switches 40 through 90. Operation of the various function switches cause the functions shown to be executed. It should be noted that switch 40 functions as a flip-flop. If the traveler time function is active, operation of this switch resets it, leaving, in this embodiment, the user displaying the departure time zone time. If the traveler time function is not active, operation of switch 40 causes the instructions explained in FIG. 2D to be executed. These instructions initialize the traveler time function and commence operation of the adjustment. The user may enter the trip time by operating switch 55 to cause display of the last trip time. Switches 80 and 90 may be operated to adjust this time. Logic to reset the hours after 23 and minutes after 59 is provided but is not shown in view of its conventionality. The user may operate switches 45 through 90 in any order desired.

FIG. 2D shows the sequence of instructions which are executed in response to closure of switch 40 when the traveler time function is not already active. The destination time zone time is compared to the departure time zone time. If the destination time zone time is greater than the departure time zone time, the watch determines whether this difference exceeds 12 hours. If so, it is assumed that the destination time zone is actually earlier than (west of) the departure time zone and a negative difference (D) is calculated. If the difference is less than twelve hours, it is assumed that the destination time zone is later than (east of) the departure time zone and a positive difference (D) is calculated. Similar logic is applied to combinations where the destination time zone time is less than the departure time zone time. This logic is necessary in a watch without an internal date function, since it must correctly account for a departure time zone time in one day and a destination time zone time in another. For example, a traveler departing San Francisco for Boston at 23:00 would show a destination time zone time of 02:00. The logic shown in FIG. 2D correctly calculate the difference (D) as +3 and not −21. Of course, watches capable of incorporating the date into the difference calculation do not require that this assumption be made.

Once the time difference (D) is known and the trip time (Z) has been entered, it is simple to calculate the update rate (R). This is the number of "ticks" (1/64 second) before incrementing the seconds counter for the traveler function. This done, the tick counter is reset, the traveler time is set to the departure time and displayed, the function in progress flag is set, and the function is under way. The function will continue until the user resets it by pressing switch 40 or until the traveler's time arrives at the destination time zone time, after the specified trip time has elapsed. Note that the user may elect to view destination and/or departure time zone time at any point during the trip without disturbing the function. This is accomplished by operating switches 45 and/or 60. To return to the traveler's time display, the user simply operates switch 50.

FIG. 3—DISPLAYED AND ZONE TIMES

FIGS. 3A through 3E show the time which would appear on an analog embodiment of the watch during a typical operation of the function. In this example, the user is traveling from Boston to San Francisco, a time difference of −3 hours. The user has set the destination time zone time into register Y (155). The user has specified a trip time of six hours into register Z (156). The function is activated at exactly 8:00 AM EST.

Figures 3A, 3B, 3C, 3D, 3E:
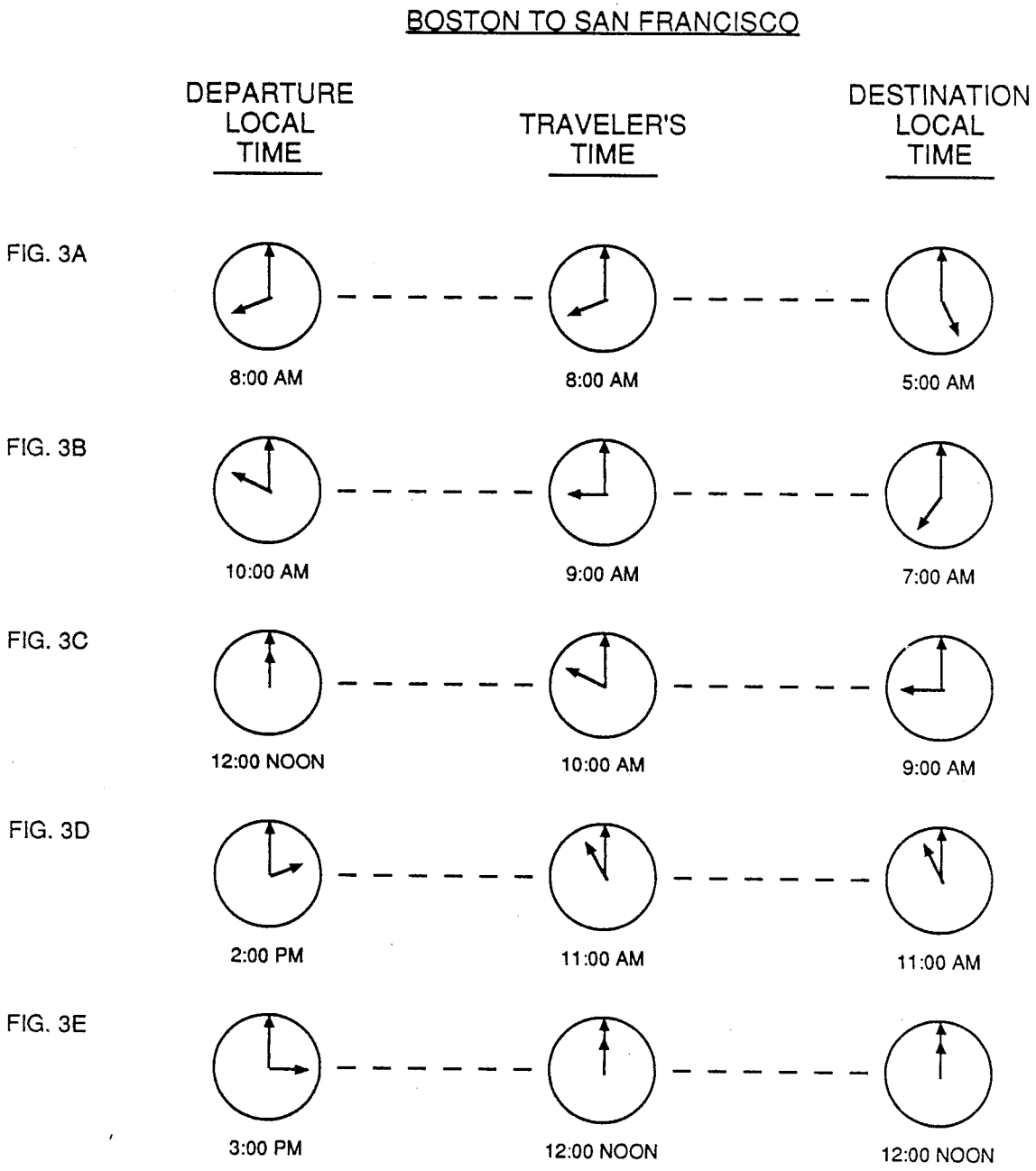

In FIG. 3A it can be seen that the traveler's time indicates the same time as the actual time in the departure location. Note that the destination (San Francisco) time is 5:00 AM, three hours earlier.

In FIG. 3B, two hours have elapsed so that Boston time is 10:00 AM, and San Francisco time is 7:00 AM, yet the traveler's time has only increased by one hour, to 9:00 AM. The traveler is being slowly eased into the San Francisco time zone. By allowing the transition to take place progressively throughout the flight, the watch is assisting the traveler to adapt to the new time zone.

In FIG. 3C, another two hours have elapsed and one hour more has elapsed for the traveler's time display, i.e., the traveler's time display is continuing to approach San Francisco time zone time. Boston time is now 12:00 noon, and San Francisco time is 9:00 AM. The traveler's time display indicates 10:00 AM. The traveler continues to consult the watch in a normal fashion, notices the change in time and continues to become psychologically acclimated to the time indicated in the display.

In FIG. 3D, it can be seen that six hours have elapsed in the departure and destination time zones. Boston time is now 2:00 PM, and San Francisco time is 11:00 AM. The traveler's time display has increased by one more hour and now indicates 11:00 AM, the exact time in the destination location. The watch display now proceeds at a normal rate. The traveler has been gradually brought into the destination time zone and will not experience any jolt when the local time is announced to the passengers. The traveler is already acclimated to the San Francisco local time.

In FIG. 3E, one hour has elapsed since arrival at the destination time zone's time. Boston time is now 3:00 PM, and San Francisco is 12:00 noon. The traveler's display reads 12:00 noon. The watch has been running at a normal speed for one hour. The traveler is operating on San Francisco time, fully psychologically acclimated to the local time zone. It can be seen that the traveler's watch will continue to indicate destination time zone time until such time as the function is activated again.

CONCLUSIONS, RAMIFICATIONS, AND SCOPE

As described above, the traveler time function can be incorporated into a standard electronic watch having a date function so that the date will be incremented or decremented if the local time change caused by passage through time zones also results in a date change.

The traveler's time function can also be incorporated into otherwise conventional digital watches, including those having a world time display, e.g., such as the watch sold under the trademark CASIO DATA BANK by Casio, Inc., Fairfield, N.J. This watch displays local time and also the corresponding local times in all of the different time zones of the world.

In addition to a digital watch, my traveler's time function can be incorporated into an analog watch, such as the one described in Patent 4,505,594, to Kawahara et al. (1985). Further, the function can be incorporated into clocks having either an analog or digital display.

Thus it is seen that my invention provides a timepiece which can be carried on the person, which reduces jet lag caused by travel between different time zones. My timepiece assists the wearer to acclimate to local time changes caused by easterly or westerly travel, by permitting the wearer to acclimate over the course of the trip. Further, my timepiece is economical to construct and need not cost appreciably more than a conventional electronic watch having a plural function display capability.

Also, it should be understood that the implementation shown is merely one example and should not be considered as limiting in any way the scope of the invention. For example, the invention can be used to adjust a timepiece from different time standards other than time zones, e.g., from standard time to daylight savings time and vice versa within a given time zone. In this application, the timepiece can contain a function button to activate the loss or gain of one hour over a specified period, e.g., five hours, to give the user time to acclimate to the time change. The number of switches can be reduced by assigning several functions to each switch, with the mode of the switches determined by the setting of a mode switch. The display can be capable of showing three or more time zones. Audible time indications may be included in the watch, setting means may vary, etc. Therefore, the scope of the invention should be determined by the appended claims and their legal equivalents and not by the examples given.

I claim:

1. In a timepiece for continuously advancing an indication of time at a standard rate, an improvement for assisting a user to accommodate to a change, over a given adaptation period, from one time standard originally applicable to said user, to another different time standard, subsequently applicable to said user, comprising:

input means for supplying to said timepiece, control data representing at least two of the following: said one time standard originally applicable to said user, said other time standard, subsequently applicable to said user, and said adaptation period;

storage means for storing data representing the time under said original time standard, the time under said other time standard, and said adaptation period;

calculation means, responsive to said data in said storage means, for automatically calculating and supplying, during said adaptation period, output data representing a non-standard rate of advance of time for said timepiece based upon said control data, such that said non-standard rate of advance will correspond to the rate at which time would progress if the time standard experienced by said user gradually changed during said adaptation period from said original time standard to said other time standard;

display means, responsive to said output data of said calculation means, for indicating time to said user at said non-standard rate during said adaptation period, such that the time indicated by said timepiece varies gradually during said adaptation period, between the time under said original time standard and the time under said other time standard, and such that said user, by observing said timepiece during said adaptation period, will tend to become gradually psychologically adapted to the time under said other time standard.

2. The timepiece of claim 1, wherein said calculation means is also arranged to revert, automatically, to increment said displayed time at said normal rate when said given adaptation period has elapsed.

3. The timepiece of claim 1, wherein said storage means is arranged to receive the time under said original time standard and said other time standard and thereupon automatically select said given adaptation time based upon the difference in said time standards and a prearranged estimated adaptation period.

4. The timepiece of claim 1, wherein said storage means is arranged to receive the time under said original time standard, said other time standard, and said given adaptation period.

5. The timepiece of claim 1, further including means for causing said calculation means to cause said display means also to show times under both said original and said other time standard.

6. The timepiece of claim 1, further including selection means for causing said display means to display either time under said original time standard, time under said other time standard, or time as determined by said non-standard rate.

7. The timepiece of claim 1, further including clock means arranged to produce a standard time signal representing the progression of time at said standard rate and wherein said storage means is arranged to receive said standard time signal and input data representing (1) a time correction for the time difference between said two time standards, (2) the direction of said time correction, and (3) said given adaptation period.

8. A timepiece for a user experiencing at least one change of time standards, from one time zone to a different time zone, within a given adaptation period, comprising:

clock means for producing a normal time signal representing the progression of time at a normal rate;

storage means arranged to receive said normal time signal and input data representing (1) a time correction for the time difference between said two time zones, (2) the direction of said time correction, and (3) said given adaptation period;

calculation means arranged to produce a modified time signal having a frequency which is greater or lesser than that of said normal time signal by an amount determined by said time correction and said given adaptation period;

loading means for loading said input data into said storage means;

display means responsive to said normal and said modified time signals for displaying time; and selection means for selectively applying said normal time signal and said modified time signal to said display means so that said modified time signal is applied to said display means during said adaptation period, whereby the time displayed by said display means will gradually change to effect said time correction in a gradual manner over said adaptation period, such that said user, by observing said timepiece during said adaptation period, will tend to become gradually psychologically adapted to the time under said different time zone standard.

9. The timepiece of claim 8, wherein said display means is arranged to provide an analog display.

10. The timepiece of claim 8, wherein said display means is arranged to provide a digital display.

11. A timepiece for a user experiencing a change of time standards during a given adaptation period, from one time zone standard to a different time zone standard, comprising:

display means responsive to a time signal for displaying time represented by said time signal;

processing means connected to provide a plurality of time signals to said display means, one of said time signals being a normal time signal representing time advancing at a normal rate as would be experienced by a person not experiencing a change of applicable time standards, another of said time signals being a modified signal representing time advancing at a modified rate as would be required to adjust, in said given adaptation period, the time standard from that in said one time zone to that in said different time zone;

data entering means arranged to enter control data representing said change in time standards and said given adaptation period into said processing means; and selection means arranged to cause said display means to display the time represented by said modified time signal during said adaptation period, and said normal time signal thereafter, whereby the time displayed by said display means will change gradually to effect said time correction in a gradual manner over said adaptation period, such that said user, by observing said timepiece during said adaptation period, will tend to become gradually psychologically adapted to the time under said different time zone standard.

12. The timepiece of claim 11, wherein said display means is arranged to display a plurality of times as represented by said normal and said modified time signals.

13. The timepiece of claim 11, wherein said processing means is arranged to supply three time signals to said display means, two of said signals being normal time signals representing time advancing at a normal rate as would be experienced by persons in said two time zones, the third of said time signals being said modified signal, said display means being arranged to display the time represented by said three time signals.

14. The timepiece of claim 11, wherein said display means is arranged to provide an analog display.

15. The timepiece of claim 11, wherein said display means is arranged to provide an digital display.

* * * * *